US008257240B2

(12) United States Patent
Klintenstedt

(10) Patent No.: US 8,257,240 B2
(45) Date of Patent: Sep. 4, 2012

(54) COMPRESSIBLE DISC UNIT FOR A CENTRIFUGAL SEPARATOR

(75) Inventor: Kjell Klintenstedt, Saltsjo-boo (SE)

(73) Assignee: Aifa Laval Corporate AB, Lund (SE)

( * ) Notice: Subject to any disclaimer, the term of this patent is extended or adjusted under 35 U.S.C. 154(b) by 0 days.

(21) Appl. No.: 12/531,130

(22) PCT Filed: Mar. 3, 2008

(86) PCT No.: PCT/SE2008/000169

§ 371 (c)(1),
(2), (4) Date: Oct. 16, 2009

(87) PCT Pub. No.: WO2008/111889

PCT Pub. Date: Sep. 18, 2008

(65) Prior Publication Data

US 2010/0099545 A1 Apr. 22, 2010

(30) Foreign Application Priority Data

Mar. 14, 2007 (SE) ..... 0700634

(51) Int. Cl.
*B04B 1/08* (2006.01)

(52) U.S. Cl. ..... 494/64; 494/70

(58) Field of Classification Search ..... 494/64, 494/67–73

See application file for complete search history.

(56) References Cited

U.S. PATENT DOCUMENTS 920,481 A * 5/1909 Kimball ..... 494/64
2,104,683 A * 1/1938 Van Rosen et al. ..... 55/403
2,403,089 A * 7/1946 Lars ..... 494/42
2,725,190 A * 11/1955 Hein et al. ..... 494/70
2,808,201 A * 10/1957 Jean ..... 494/38
2,941,872 A * 6/1960 Pilo et al. ..... 422/259
3,279,686 A * 10/1966 Hubmann ..... 494/36
4,262,841 A * 4/1981 Berber et al. ..... 494/66
4,464,163 A * 8/1984 Heckmann et al. ..... 494/64
4,701,158 A * 10/1987 Inge et al. ..... 494/74
5,045,049 A * 9/1991 Lantz ..... 494/70
5,052,996 A * 10/1991 Lantz ..... 494/68
5,362,292 A * 11/1994 Borgstrom et al. ..... 494/74
5,637,217 A 6/1997 Herman et al.
5,720,705 A * 2/1998 Inge et al. ..... 494/37

(Continued)

FOREIGN PATENT DOCUMENTS

SE 146598 C 8/1954

(Continued)

*Primary Examiner* — Charles E Cooley
(74) *Attorney, Agent, or Firm* — Michaud-Kinney Group LLP

(57) ABSTRACT

In a compressible unit a plurality of separating discs are provided and adapted to being capable, in a compressed state, of being mounted in and removed from a centrifugal separator rotor, which rotor during operation is rotatable about an axis of rotation. The unit includes a support, a pressure surface, between which the separating discs are disposed abutting against one another. Guide surfaces abut against the separating discs and control radial and polar position. At least one compression mechanism is adapted during compression of the unit to press the support and pressure surface towards one another so that the discs are compressed. During compression, the guide surfaces allow relative movement between the support and pressure surface and the separating discs, and are of at least sufficient extent in the compression direction for the position-controlling abutment between the guide surfaces and the separating discs to be maintained throughout the relative movement during the compression.

8 Claims, 3 Drawing Sheets

U.S. PATENT DOCUMENTS

| | | | | |
|---|---|---|---|---|
| 5,733,239 | A * | 3/1998 | Inge et al. | 494/71 |
| 6,533,713 | B1 * | 3/2003 | Borgstrom et al. | 494/66 |
| 7,306,556 | B2 * | 12/2007 | Pitkamaki et al. | 494/67 |
| 7,731,772 | B2 * | 6/2010 | Lagerstedt et al. | 55/407 |
| 2006/0100083 | A1 * | 5/2006 | Lagerstedt et al. | 494/70 |
| 2006/0135339 | A1 * | 6/2006 | Sandgren | 494/68 |
| 2007/0032363 | A1 * | 2/2007 | Pitkamaki et al. | 494/67 |
| 2009/0137378 | A1 * | 5/2009 | Klintenstedt | 494/60 |
| 2010/0099545 | A1 * | 4/2010 | Klintenstedt | 494/79 |
| 2011/0136649 | A1 * | 6/2011 | Lindroth et al. | 494/74 |
| 2011/0237417 | A1 * | 9/2011 | Rudman et al. | 494/70 |

FOREIGN PATENT DOCUMENTS

| | | | |
|---|---|---|---|
| WO | 96/27445 | * | 9/1996 |
| WO | 2004020105 | | 3/2004 |

* cited by examiner

COMPRESSIBLE DISC UNIT FOR A CENTRIFUGAL SEPARATOR

FIELD OF THE INVENTION

The present invention relates to a compressible unit comprising a plurality of separating discs and adapted to being capable, in a compressed state, of being mounted in a rotor of a centrifugal separator and being taken out of the rotor, which during operation with the unit mounted therein is rotatable about an axis of rotation. This unit comprises a support means and a pressure means, between which support and pressure means the separating discs are disposed abutting against one another. The unit further comprises a central control means provided with guide surfaces which abut against the separating discs and control the latter's radial and polar position, and at least one compression means adapted, during compression of the unit in a compression direction, to pressing the support and pressure means towards one another in such a way that the separating discs disposed between them are compressed.

BACKGROUND OF THE INVENTION

Patent document SE 146 598 discloses a compressible unit, but the compression of the stacked separating discs is effected, after an insert has been moved down in the rotor body, by an expensive compression tool in a labour-intensive process.

U.S. Pat. No. 5,637,217 and WO 2004/020105 refer to examples of centrifugal separators provided with inserts of separating discs in the form of units which are held together and compressed by a plurality of rods or bolts through the disc set, thereby disturbing the flow through the disc set and hence the separation results. A large number of parts also have to be handled during assembly and disassembly, which are therefore labour-intensive operations.

SUMMARY OF THE INVENTION

The object of the present invention is to propose a compressible unit which comprises a plurality of separating discs of the kind indicated above and is easy to assemble and disassemble outside the rotor of the centrifugal separator and easy to compress without any expensive compression tools.

Another object is to propose a compressible unit which is easy to replace, inspect and modify as the need arises.

A further object is to propose a compressible unit which can be balanced separately, making it easy to replace without having to rebalance the rotor of the centrifugal separator.

According to the present invention, guide surfaces are provided as part of a central control means in a compressible unit which comprises a plurality of separating discs of the kind indicated above being so configured that during compression they allow relative movement between the support and pressure means and the separating discs disposed between them, and being of at least sufficient extent in the compression direction for the position-controlling abutment between the guide surfaces and the separating discs to be maintained throughout the relative movement during the compression.

According to an embodiment of the invention, the compressible unit has in the compression direction an extent which is reduced by at least five percent during the compression.

According to another embodiment of the invention, the compressible unit has in the compression direction an extent which is reduced by at least ten percent during the compression.

According to a preferred embodiment of the invention, the unit is compressed in a compression direction which is parallel with the axis of rotation. In this context, the compression means is preferably disposed between at least one out of the support and pressure means and the control means, which latter in turn abuts against the other out of the support and pressure means via axially facing pressure-transmitting contact surfaces in such a way that during compression the control means together with the other out of the support and pressure means and the separating discs disposed between the support and pressure means is pressed towards the first out of the support and pressure means.

According to another embodiment of the invention, the unit also comprises an inlet chamber which is formed within the control means and which is provided a plurality of inlet discs for entraining during operation a liquid mixture of components which is to be separated.

According to still another embodiment of the invention, the unit also comprises an outlet chamber which is formed within the control means and which is connected to the radially outer region of the control means via at least one outlet passage disposed in the control means.

BRIEF DESCRIPTION OF THE DRAWINGS

The invention is described below in more detail with reference to the attached drawings, in which.

DETAILED DESCRIPTION OF VARIOUS EMBODIMENTS OF THE INVENTION

Figure 1:
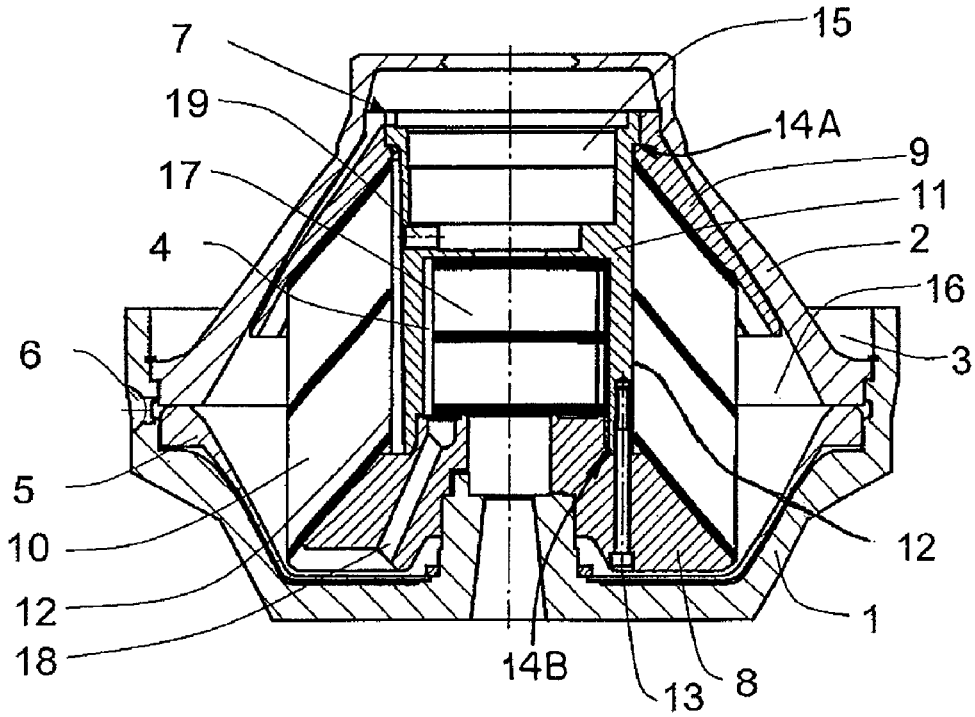
FIG. 1 depicts schematically a rotor of a centrifugal separator, which rotor is provided with a compressed disc unit in accordance with the present invention, in axial section.

The rotor depicted in FIG. 1 has a lower element 1 and an upper element 2 which are held together by a locking ring 3. As a depicted example of many possible rotors which might be provided with a compressible unit according to the present invention, it is adapted to being mounted on a hollow drive shaft (not shown) through which the liquid mixture of components which is to be separated is supplied to a central inlet chamber 4 in the rotor. The rotor depicted is provided with an axial tubular valve slide 5 adapted to intermittently open and close a passage, closed in the drawing, between the inside of the rotor and outlet apertures 6 disposed in the lower element of the rotor.

Figure 3:
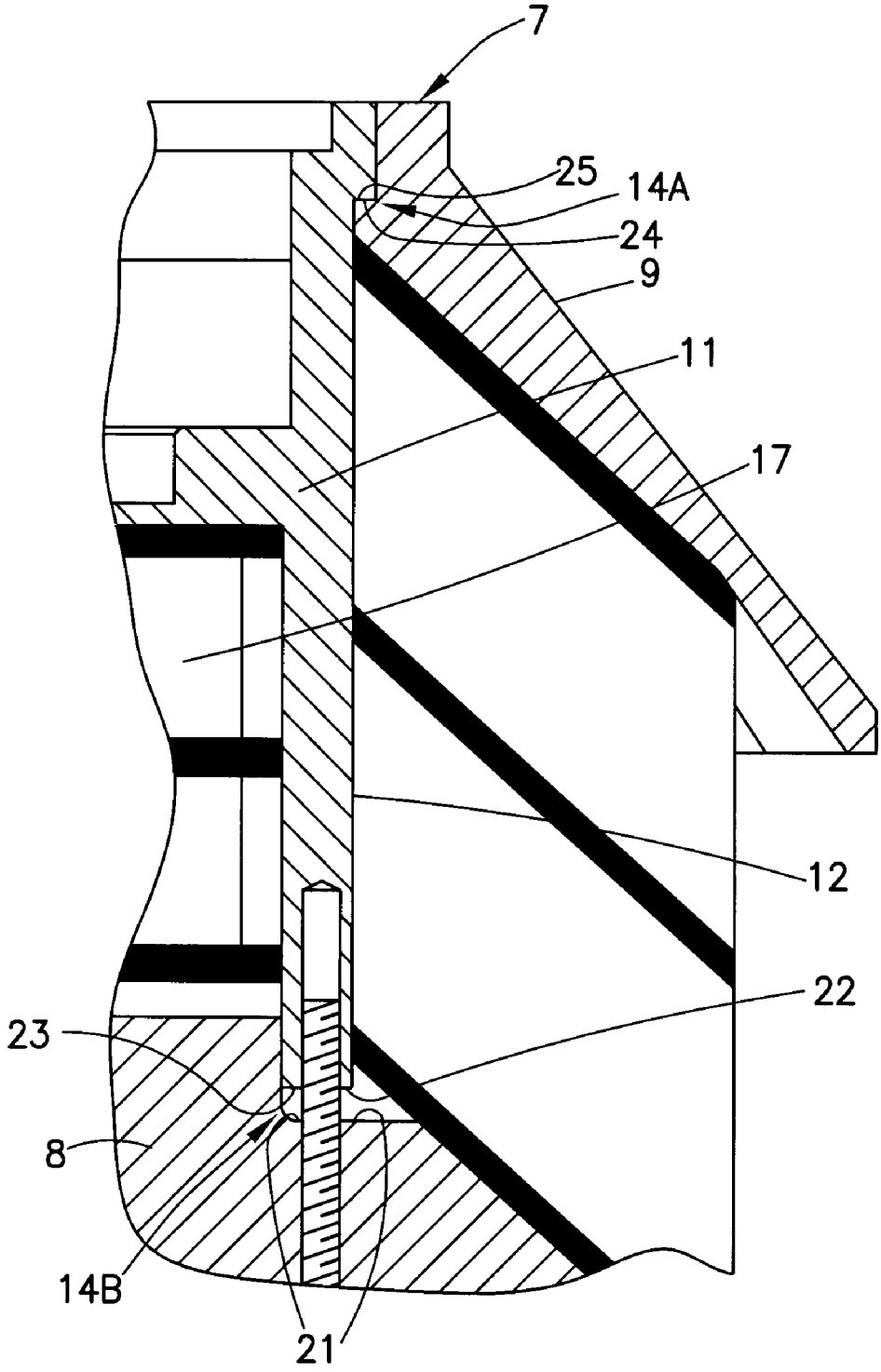
FIG. 3 is an enlarged view of a portion of the uncompressed disc unit of FIG. 2.

Centrally in the rotor, a compressible unit 7 according to the present invention is disposed axially between the valve slide 5 and the upper element 2. The compressible unit has a support means 8, a pressure means 9 and a stack of a plurality of truncated conical separating discs 10 disposed therebetween. The separating discs 10 define intermediate spaces in which the main separation takes place during operation. The unit 7 is provided centrally with a control means 11 which have a number of guide surfaces 12 which abut against the separating discs 10 and control the radial and polar position of the separating discs at the radially inner edge of the separating discs. A compression means 13 is disposed between the support means 8 and the control means 11 or between the pressure means 9 and the control means 11. In the example depicted, the compression means 13 takes the form of a screw disposed between the support means 8 and the control means 11. The control means 11 abuts against the pressure means 9, via axially facing pressure-transmitting contact surfaces 14A in such a way that during compression the control means 11 together with the pressure means 9 press the separating discs 10 against the support means 8. In another embodiment, the control means 11 abuts against the support means, via axially facing pressure-transmitting contact surfaces 14B in such a way that during compression the control means 11 together with the support means 8 press the separating discs 10 against the pressure means 9. With reference to FIG. 3, the axially facing pressure-transmitting contact surfaces 14B include the axially facing surfaces 21 on the support means 8 and the axially facing surfaces 22 and 23 on the control means 11. The axially facing pressure-transmitting contact surfaces 14A include the axial facing surface 24 on the control means 11 and the axially facing surface 25 on the pressure means 9.

In the unit depicted by way of example, an inlet chamber 4 and an outlet chamber 15 are formed centrally within the control means. In the inlet chamber 4 a plurality of inlet discs 17 are adapted to entraining, during operation, a liquid mixture of components which are to be separated, and the inlet chamber 4 communicates with a separating chamber 16 via a number of distribution ducts 18. The outlet chamber 15 communicates with the separating chamber 16 via at least one outlet passage 19 disposed in the control means.

Figure 2:
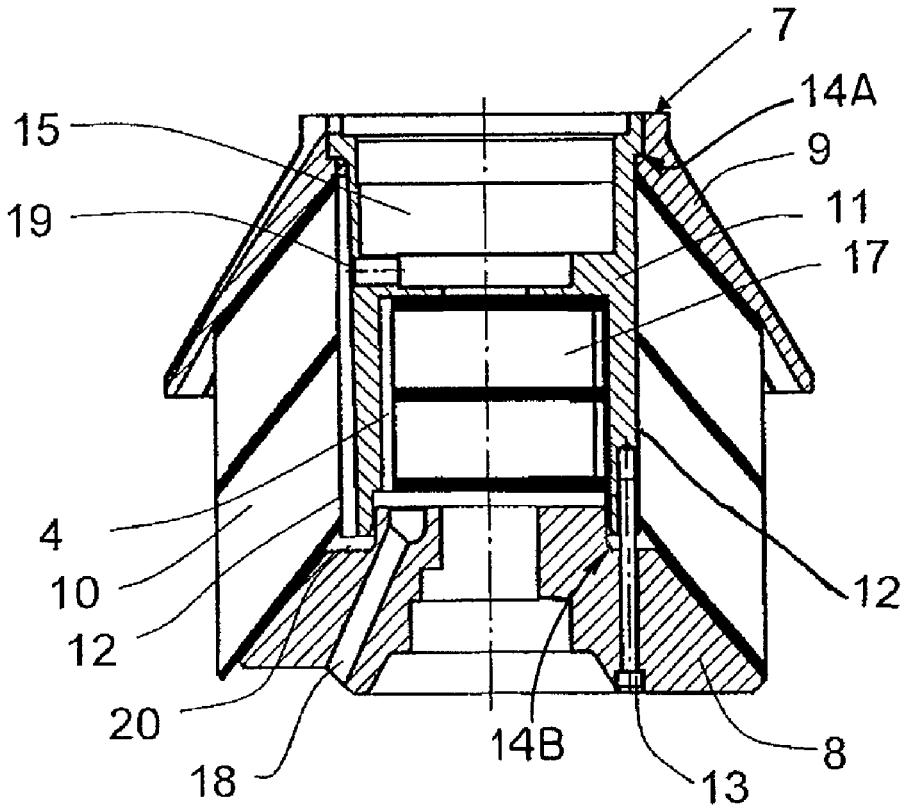
FIG. 2 depicts schematically an uncompressed disc unit in accordance with the present invention, in axial section, which is not mounted in a rotor of a centrifugal separator.

Since the unit depicted in FIG. 1 is mounted in the rotor, it is compressed. FIG. 2 depicts the same unit not mounted in a rotor and not compressed, as indicated by the axial distance 20 between the support means 8 and the control means 11.

In the example depicted, the separating discs are conical and compressed in a direction which is parallel with the axis of rotation, but it is also possible to apply the invention with conventional axial separating discs which are compressed in the circumferential direction.

Thanks to the present invention a compressible unit comprising a plurality of separating discs is accomplished which is easy to assemble and disassemble outside the rotor of the centrifugal separator, easy to compress without any expensive compression tools and easy to replace, inspect and modify as the need arises.

A compressible unit according to the present invention can also be balanced separately, making it possible for it to be replaced without having to rebalance the rotor of the centrifugal separator.

What is claimed is:

1. A compressible disc unit comprising:

a plurality of separating discs which when, in a compressed state, are removably mountable in a rotor of a centrifugal separator and wherein the rotor with the compressible disc unit mounted therein is rotatable about an axis of rotation, support means, a pressure means, the separating discs are positioned between the support means and the pressure means;

central control means having guide surfaces which movably abut the separating discs and control the radial and polar position of the separating discs, and at least one compression means operable to compress the support and pressure means towards one another and being disposed between the control means and at least one of the support means and the pressure means;

the pressure means and the central control means are moveably positioned relative to the support means; and the pressure means and the central control means are operable to maintain the abutment between the guide surfaces and the separating discs during compression of the separating discs from an uncompressed position to a compressed position.

2. A compressible disc unit according to claim 1, wherein, the disc unit is operable to be compressed by at least five percent between the uncompressed position and the compressed position.

3. A compressible disc unit according to claim 1, wherein, the disc unit is operable to be compressed by at least ten percent between the uncompressed position and the compressed position.

4. A compressible disc unit according to claim 1 wherein the disc unit is compressed in a direction substantially parallel with the axis of rotation.

5. A compressible disc unit according to claim 4, wherein the control means abuts against at least one of the support means and pressure means via axially facing pressure-transmitting contact surfaces defined by respective portions of the control means, the support means and the pressure means.

6. A compressible disc unit according to claim 1, further comprising an inlet chamber which is formed within the control means and which is provided with a plurality of inlet discs for entraining during operation a liquid mixture of components which is to be separated.

7. A compressible disc unit according to claim 1, further comprising an outlet chamber which is connected to a radially outer region of the control means via at least one outlet passage disposed in the control means.

8. A compressible disc unit according to claim 1, wherein the separating discs have a truncated conical shape.

* * * * *